US007692481B2

(12) United States Patent
Roh et al.

(10) Patent No.: US 7,692,481 B2
(45) Date of Patent: Apr. 6, 2010

(54) BAND-GAP REFERENCE VOLTAGE GENERATOR FOR LOW-VOLTAGE OPERATION AND HIGH PRECISION

(75) Inventors: Jeong Jin Roh, Gyeonggi-do (KR); Hyung Dong Roh, Seoul (KR); Hyoung Joong Kim, Seoul (KR); Yi Gyeong Kim, Daejeon (KR); Jong Kee Kwon, Daejeon (KR)

(73) Assignees: Electronics and Telecommunications Research Institute, Daejeon (KR); Industry-University Cooperation Foundation Hanyang University, Ansan-Si (KR)

( * ) Notice: Subject to any disclaimer, the term of this patent is extended or adjusted under 35 U.S.C. 154(b) by 0 days.

(21) Appl. No.: 12/195,260

(22) Filed: Aug. 20, 2008

(65) Prior Publication Data

US 2009/0128230 A1 May 21, 2009

(30) Foreign Application Priority Data

Nov. 15, 2007 (KR) ..... 10-2007-0116509

(51) Int. Cl.
*G05F 1/10* (2006.01)
*G05F 3/02* (2006.01)

(52) U.S. Cl. ..... 327/539; 327/538; 327/541; 232/312; 232/313

(58) Field of Classification Search ..... 327/530, 327/538–543, 546; 323/312–317
See application file for complete search history.

(56) References Cited

U.S. PATENT DOCUMENTS 5,818,406 A * 10/1998 Tsuchi et al. ..... 345/89
6,292,050 B1 * 9/2001 Dooley et al. ..... 327/540
6,750,684 B2 * 6/2004 Lim ..... 327/108
2005/0194957 A1 * 9/2005 Brokaw ..... 323/316
2007/0164721 A1 * 7/2007 Han ..... 323/312
2007/0252573 A1 * 11/2007 Tachibana et al. ..... 323/313

FOREIGN PATENT DOCUMENTS

JP 05-241672 A 9/1993
JP 2000-284844 A 10/2000
JP 2006-119758 A 5/2006
KR 1995-0003019 B1 3/1995
KR 2001-0076623 A 8/2001
KR 2004-0065326 A 7/2004

OTHER PUBLICATIONS

Pierazzi et al., "Band-Gap References for near 1-V operation in standard CMOS technology," IEEE 2001 Custom Intergrated Circuits Conference, pp. 463-466.
Behzad Razavi, "Design of Analog CMOS Integrated Circuits," BANDGAP References, pp. 384-392.

* cited by examiner

*Primary Examiner*—Lincoln Donovan
*Assistant Examiner*—Brandon S Cole

(57) ABSTRACT

Provided is a band-gap reference voltage generator for low-voltage operation and high precision. The band-gap reference voltage generator minimizes voltage drop by connecting resistors in parallel to bipolar transistors, and cancels temperature dependence by properly adjusting a resistor of an output stage, so that it can provide a stable reference voltage that is unaffected by a change in temperature in spite of a low power supply voltage. Further, the band-gap reference voltage generator minimizes variation of the reference voltage caused by offset noise by switching of input and output voltages at input and output stages of a feedback amplifier, so that it can provide a precise reference voltage.

10 Claims, 5 Drawing Sheets

BAND-GAP REFERENCE VOLTAGE GENERATOR FOR LOW-VOLTAGE OPERATION AND HIGH PRECISION

CROSS-REFERENCE TO RELATED APPLICATION

This application claims priority to and the benefit of Korean Patent Application No. 2007-116509, filed Nov. 15, 2007, the disclosure of which is incorporated herein by reference in its entirety.

BACKGROUND

1. Field of the Invention

The present invention relates to a band-gap reference voltage generator for low-voltage operation and high precision, and more particularly, to a band-gap reference voltage generator for low-voltage operation and high precision which is relatively unaffected by offset noise and capable of providing stable reference voltage even at a power supply voltage of 1V or less.

This work was partly supported by the IT R&D program of MIC/IITA [2006-S006-02, Part/Module for ubiquitous terminal].

2. Discussion of Related Art

In general, all analog/radio frequency (RF) or digital circuits integrated into a chip need a stable, precise bias voltage for efficient operation.

However, the bias voltage provided by a typical bias circuit deviates from a constant value over time due to change in the temperature of the bias circuit during operation.

For this reason, a band-gap reference voltage generator is used to provide a stable reference voltage in spite of temperature change using the temperature dependence of a bipolar transistor (or diode).

FIG. 1 is a circuit diagram of a known complementary metal oxide semiconductor (CMOS) band-gap reference voltage generator.

Referring to FIG. 1, the known CMOS band-gap reference voltage generator comprises first, second and third p-channel metal oxide semiconductor (PMOS) transistors M1, M2 and M3, a feedback amplifier AMP, first and second resistors $R_1$ and $R_2$, and first, second and third bipolar transistors Q1, Q2 and Q3.

Here, a first node voltage −Vin and a second node voltage +Vin have the same value due to virtual ground of the feedback amplifier AMP. More specifically, when the first node voltage −Vin is lower than the second node voltage +Vin, an output voltage of the feedback amplifier AMP is increased, and thus current flowing to the first resistor $R_1$ is decreased. The decreased current flows to the second bipolar transistor Q2, and thus the second node voltage +Vin is decreased. In contrast, when the first node voltage −Vin is higher than the second node voltage +Vin, the output voltage of the feedback amplifier AMP is decreased, and thus current flowing to the first resistor $R_1$ is increased. The increased current flows to the second bipolar transistor Q2, and thus the second node voltage +Vin is increased.

A reference voltage $V_{ref}$ output from the band-gap reference voltage generator configured in this way is unaffected by changes in temperature, as explained mathematically below.

Since the feedback amplifier AMP has the same voltages +Vin and −Vin across its inputs due to its virtual ground, the second node voltage +Vin is equal to a base-emitter voltage $V_{BE1}$ of the first bipolar transistor Q1. Thus, the voltage applied to the first resistor $R_1$ is as follows: $\Delta V_{BE}=V_{BE1}-V_{BE2}$. When converted with respect to temperature, the voltage $\Delta V_{BE}$ can be expressed as in Equation 1 below.

$$\begin{aligned}\Delta V_{BE} &= V_{BE1} - V_{BE2} \\ &= V_T \ln\frac{I_{C1}}{I_{S1}} - V_T \ln\frac{n \cdot I_{C2}}{I_{S2}} \\ &= V_T \ln n\end{aligned} \quad \text{Equation 1}$$

Here, Is is a saturation current which is proportional to the number of bipolar transistors, Ic is a current flowing to the bipolar transistor, n is the number of bipolar transistors, and $V_T$ is a thermal voltage that has a value of about 25 mV at room temperature.

In Equation 1, the natural logarithm of the number of bipolar transistors (ln n) is a constant, and thus the rate of change of $\Delta V_{BE}$ with respect to temperature can be expressed as in Equation 2 below.

$$\frac{\partial \Delta V_{BE}}{\partial T} \approx \frac{\partial V_T}{\partial T} \approx +0.087\,\text{mV}/^\circ\text{C}. \quad \text{Equation 2}$$

The voltage $\Delta V_{BE}$ applied to the first resistor $R_1$ increases in direct proportion to temperature. The current $I_2$ flowing to the resistor $R_1$ is mirrored to the third PMOS transistor M3 with the temperature dependence of $\Delta V_{BE}$ copied without a change. The mirrored current $I_3$ flows to the second resistor $R_2$ and the third bipolar transistor Q3.

Here, the rate of change of the base-emitter voltage $V_{BE3}$ of the third bipolar transistor Q3 with respect to temperature can be expressed as in Equation 3.

$$\frac{\partial V_{BE3}}{\partial T} \approx -1.5\text{mV}/^\circ\text{C}. \quad \text{Equation 3}$$

As can be seen from Equation 3, the base-emitter voltage $V_{BE3}$ of the third bipolar transistor Q3 decreases in proportion to temperature.

Thus, since the voltage applied to the resistor $R_2$ increases in proportion to temperature, and since the base-emitter voltage $V_{BE3}$ of the third bipolar transistor Q3 decreases in proportion to temperature, the reference voltage $V_{ref}$ generated by the sum of the two voltages is unaffected by a change in temperature. The reference voltage $V_{ref}$ can be expressed as in Equation 4.

$$V_{ref} = V_{BE3} + \frac{R_2}{R_1} V_T \ln n \approx 1.25\,\text{V} \quad \text{Equation 4}$$

As can be seen from Equation 4, $V_{BE3}$ decreases in proportion to temperature, and $V_T$ increases in proportion to temperature. As such, when a resistance ratio of the first and second resistors $R_1$ and $R_2$ is properly adjusted, the reference voltage $V_{ref}$ can be held constant despite temperature change.

As described above, the known band-gap reference voltage generator configured as in FIG. 1 cannot be applied to a circuit design for an applied voltage of 1V or less, because the theoretical reference voltage $V_{ref}$ has a perfect temperature compensation characteristic in the proximity of about 1.25V, as shown by Equation 4. Furthermore, a power supply of at least 1.5V is required to guarantee smooth operation of the transistors used in the reference voltage generator.

Mobile communication terminals which have attracted the most attention in recent years employ a low-power consumption design for a core chip in order to achieve portability and long battery life.

However, the problem with applying a low supply voltage for the low-power consumption design is that a band-gap bias circuit functioning as a core in the chip needs a working power supply of at least 1.5V, as described above.

An input stage of the feedback amplifier AMP of FIG. 1 is generally designed with two CMOS transistors. Although the two CMOS transistors have identical designs, it is difficult to fabricate them to have exactly the same characteristics due to process fluctuations. This characteristic difference between the transistors causes an offset. In this case, the first node voltage −Vin and the second node voltage +Vin have different magnitudes, so that a precise reference voltage cannot be generated.

SUMMARY OF THE INVENTION

The present invention is directed to a band-gap reference voltage generator for low-voltage operation and high precision, which is capable of providing a stable reference voltage that is unaffected by a change in temperature, in spite of a low power supply voltage of 1V or less used to implement a low voltage design.

The present invention is also directed to a band-gap reference voltage generator for low-voltage operation and high precision, which is capable of minimizing reference voltage variation caused by offset noise generated from a feedback amplifier to thereby provide a precise reference voltage.

An aspect of the present invention provides a band-gap reference voltage generator for low-voltage operation and high precision, which includes: first through third p-channel metal oxide semiconductor (PMOS) transistors, gates and sources of which are connected to a first node and a power supply terminal respectively, drains of which are connected to second, third and fourth nodes respectively, and which are configured as current mirrors; a feedback amplifier, which includes fourth and fifth PMOS transistors configured as current mirrors and sixth and seventh n-channel metal oxide semiconductor (NMOS) transistors, wherein non-inverting and inverting input voltages are input to gates of the sixth and seventh NMOS transistors respectively, and non-inverting and inverting output voltages are output from drains of the fourth and fifth PMOS transistors respectively; a first resistor, which is connected between the second node and a fifth node; second, third and fourth resistors, which are connected between the second, third and fourth nodes and ground, respectively; a first bipolar transistor, which is connected with the second resistor in parallel, an emitter of which is connected to the fifth node, and a collector and a base of which are grounded; and a second bipolar transistor, which is connected with the third resistor in parallel, an emitter of which is connected to the third node, and a collector and a base of which are grounded. Here, a voltage between the fourth node and the ground is used as a reference voltage.

Further, the reference voltage may have a value between 0V and 1V, and the resistance of the fourth resistor may be adjusted such that the reference voltage is unaffected by a change in temperature.

In addition, in order to minimize a problem of offset noise of the feedback amplifier, the band-gap reference voltage generator may further include a first voltage modulator, which is connected between the second node and the third node, and crosses and modulates the non-inverting and inverting input voltages of the feedback amplifier; a second voltage modulator, which is connected between the first node and output terminals of the feedback amplifier, and crosses and modulates the non-inverting and inverting output voltages; and a low-pass filter, which is connected between the fourth node and the ground, and passes low-frequency signals of voltage of the fourth node.

BRIEF DESCRIPTION OF THE DRAWINGS

The above and other objects, features and advantages of the present invention will become more apparent to those of ordinary skill in the art by describing in detail preferred embodiments thereof with reference to the attached drawings, in which.

DETAILED DESCRIPTION OF EXEMPLARY EMBODIMENTS

Hereinafter, exemplary embodiments of the present invention will be described in detail with reference to the accompanying drawings. However, the present invention is not limited to the embodiments disclosed below, but can be implemented in various types. Therefore, the present embodiment is provided for complete disclosure of the present invention and to fully inform the scope of the present invention to those ordinarily skilled in the art.

Figure 1:
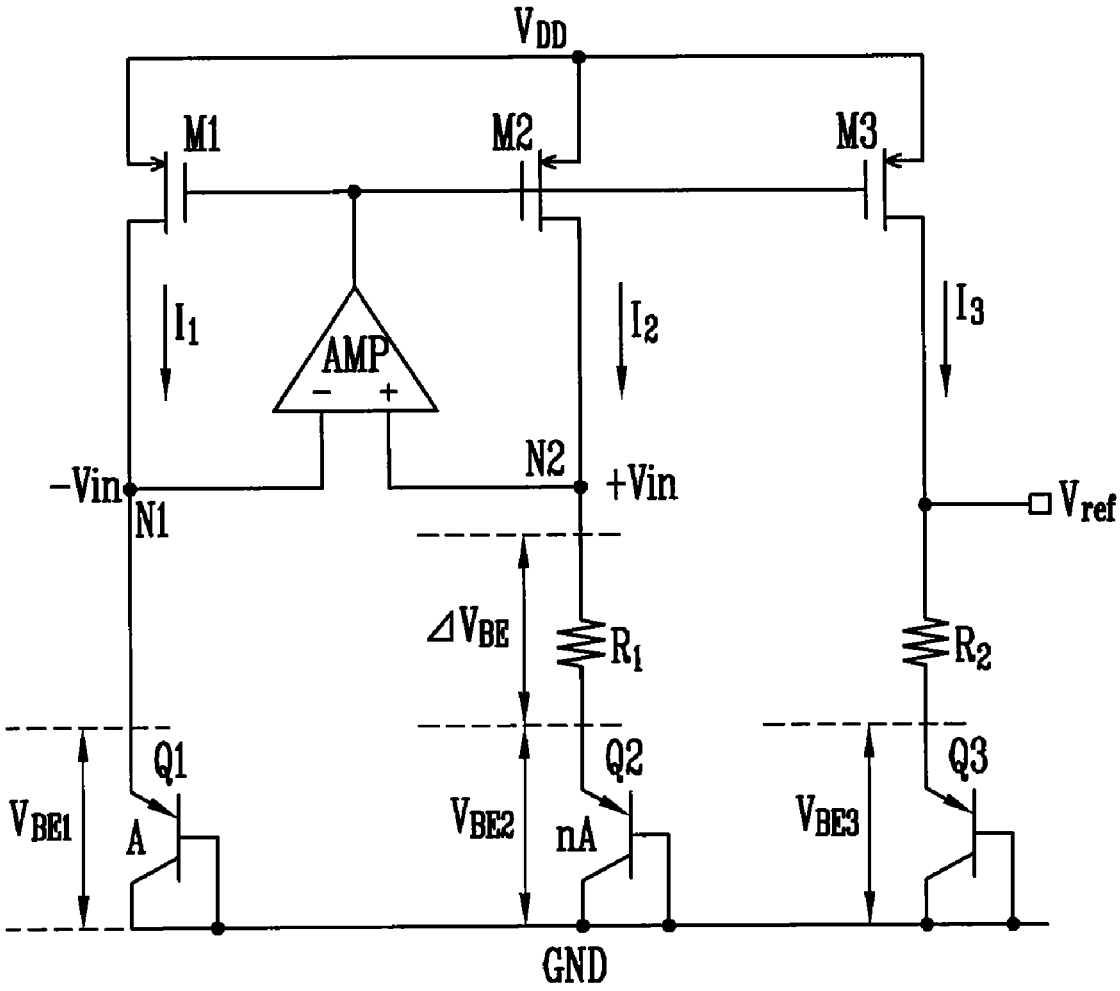
FIG. 1 (PRIOR ART)
FIG. 1 is a circuit diagram of a conventional complementary metal oxide semiconductor (CMOS) band-gap reference voltage generator.
Figure 2:
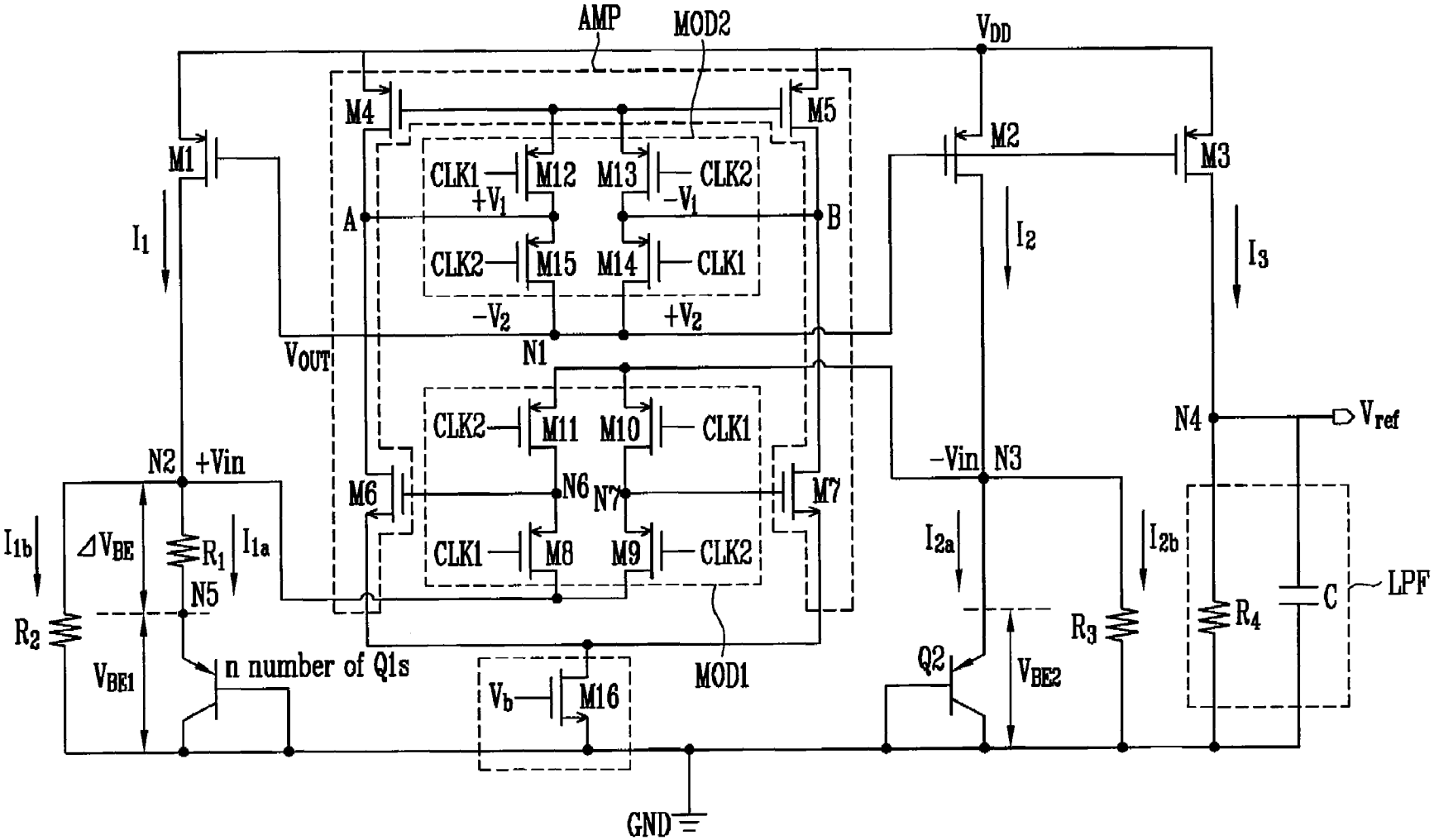
FIG. 2 is a circuit diagram of a band-gap reference voltage generator for low-voltage operation and high precision according to an exemplary embodiment of the present invention.

FIG. 2 is a circuit diagram of a band-gap reference voltage generator for low-voltage operation and high precision according to an exemplary embodiment of the present invention.

Referring to FIG. 2, the band-gap reference voltage generator for low-voltage operation and high precision according to an exemplary embodiment of the present invention comprises first through third p-channel metal oxide semiconductor (PMOS) transistors M1 through M3, a feedback amplifier AMP that includes fourth and fifth PMOS transistors M4 and M5 and sixth and seventh n-channel metal oxide semiconductor (NMOS) transistors M6 and M7, first through third resistors $R_1$ through $R_3$, a low-pass filter (LPF) that includes a fourth resistor $R_4$ and a capacitor C, first and second bipolar transistors Q1 and Q2, first and second voltage modulators MOD1 and MOD2 for eliminating offset noise, and a $16^{th}$ NMOS transistor M16 for supplying bias current.

The connection of the respective components will be described below in brief.

The first through third PMOS transistors M1 through M3 are configured as current mirrors. The first through third PMOS transistors M1 through M3 have gates connected to a first node N1 in common, sources connected to a power supply terminal $V_{DD}$ in common, and drains connected to second, third and fourth nodes N2, N3 and N4 respectively.

The feedback amplifier AMP includes the fourth and fifth PMOS transistors M4 and M5, which are configured as current mirrors, and the sixth and seventh NMOS transistors M6 and M7. Non-inverting and inverting input voltages +Vin and −Vin are input to gates of the sixth and seventh NMOS transistors M6 and M7 respectively, and non-inverting and inverting output voltages $+V_1$ and $-V_1$ are output from drains of the fourth and fifth PMOS transistors M4 and M5 respectively.

Sources of the sixth and seventh NMOS transistors M6 and M7 are connected to each other and to a drain of the $16^{th}$ NMOS transistor M16. Bias voltage $V_b$ is applied to a gate of the $16^{th}$ NMOS transistor M16.

Hereinafter, for convenience of description, the gates of the sixth and seventh NMOS transistors M6 and M7, which correspond to an input stage of the feedback amplifier AMP, are represented by sixth and seventh nodes N6 and N7, and the drains of the fourth and fifth PMOS transistors M4 and M5, which correspond to an output stage of the feedback amplifier AMP, are represented by nodes A and B.

The sixth and seventh nodes N6 and N7 are connected with the first voltage modulator MOD1 for crossing the non-inverting input voltage +Vin and the inverting input voltage −Vin, and the nodes A and B are connected with the second voltage modulator MOD2 for crossing the output voltages. The first voltage modulator MOD1 includes eighth and ninth PMOS transistors M8 and M9 and tenth and eleventh PMOS transistors M10 and M11, which serve as switches. The non-inverting input voltage +Vin is commonly applied to drains of the eighth and ninth PMOS transistors M8 and M9, while the inverting input voltage −Vin is commonly applied to sources of the tenth and eleventh PMOS transistors M10 and M11. A first clock CLK 1 is applied to gates of the eighth and tenth PMOS transistors M8 and M10, while a second clock CLK2 is applied to gates of the ninth and eleventh PMOS transistors M9 and M11. A source of the eighth PMOS transistor M8 and a drain of the eleventh PMOS transistor M11 are commonly connected to the sixth node N6. A source of the ninth PMOS transistor M9 and a drain of the tenth PMOS transistor M10 are commonly connected to the seventh node N7. The second voltage modulator MOD 2 includes twelfth and thirteenth PMOS transistors M12 and M13 and fourteenth and fifteenth PMOS transistors M14 and M15, which serve as switches. Sources of the twelfth and thirteenth PMOS transistors M12 and M13 are commonly connected to the gates of the fourth and fifth PMOS transistors M4 and M5 constituting the feedback amplifier AMP, and drains of the fourteenth and fifteenth PMOS transistors M14 and M15 are connected to the first node N1. The first clock CLK 1 is applied to gates of the twelfth and fourteenth PMOS transistors M12 and M14, while the second clock CLK2 is applied to gates of the thirteenth and fifteenth PMOS transistors M13 and M15. A drain of the twelfth PMOS transistor M12 and a source of the fifteenth PMOS transistor M15 are commonly connected to the node A. A drain of the thirteenth PMOS transistor M13 and a source of the fourteenth PMOS transistor M14 are commonly connected to the node B.

The first resistor $R_1$ is connected between the second node N2 and the fifth node N5. The second resistor $R_2$ is connected between the second node N2 and a ground terminal GND. The third resistor $R_3$ is connected between the third node N3 and the ground terminal GND.

The LPF is connected between the fourth node N4 and the ground terminal GND with the fourth resistor $R_4$ and the capacitor C connected in parallel. A terminal for the reference voltage $V_{ref}$ is connected to the fourth node N4.

The first bipolar transistor Q1 has an emitter connected to the fifth node N5, and a collector and base connected to the ground terminal GND. The second bipolar transistor Q2 has an emitter connected to the third node N3, and a collector and base connected to the ground terminal GND.

The band-gap reference voltage generator of the present invention, configured in this way, has the remarkable characteristic of being able to provide a stable reference voltage that is unaffected by a change in temperature, at a low voltage between 0V and 1V, and minimize a problem of offset noise generated from the feedback amplifier. The configuration and operation of the band-gap reference voltage generator of the present invention will be described below in detail.

(1) Provision of a Stable Reference Voltage that is Unaffected by Temperature Change at Low Voltage of 1V or Less First, when the output voltages of the feedback amplifier AMP are applied to the first, second and third PMOS transistors M1, M2 and M3 in the state where the PMOS transistors M1, M2 and M3 are in a saturation mode, the currents flowing to the PMOS transistors M1, M2 and M3 are equalized through current mirroring. In other words, the currents are expressed by $I_1=I_2=I_3$.

Here, the current $I_1$ can be divided into $I_{1a}$ and $I_{1b}$, and the current $I_2$ can be divided into $I_{2a}$ and $I_{2b}$. In other words, $I_1=I_{1a}+I_{1b}$, and $I_2=I_{2a}+I_{2b}$.

As described above, the feedback amplifier AMP has the same voltages +Vin and −Vin across its inputs due to its virtual ground. As such, when the second resistor $R_2$ is equal to the third resistor $R_3$, i.e. when $R_2=R_3$, $I_{1b}=I_{2b}$, and $I_{1a}=I_{2a}$.

The current $I_{2a}$ flowing to the second bipolar transistor Q2 can be expressed by Equation 5 below on the basis of the current formula of a bipolar transistor.

$$I_{2a}=I_S\cdot e^{V_{BE2}/V_T} \quad \text{Equation 5}$$

In Equation 5, Is represents a saturation current that is proportional to the number of bipolar transistors, $V_T$ is a thermal voltage that has a value of about 25 mV at room temperature, and $V_{BE2}$ denotes the base-emitter voltage of the second bipolar transistor Q2.

Rearranging Equation 5 to isolate the base-emitter voltage $V_{BE2}$ of the second bipolar transistor Q2 yields Equation 6 below.

$$V_{BE2} = V_T \cdot \ln\frac{I_{2a}}{I_S} \quad \text{Equation 6}$$

The base-emitter voltage $V_{BE2}$ of the second bipolar transistor Q2 given by Equation 6 varies with temperature, with a negative slope of about −1.5 mV/° C., as described above.

Further, since the feedback amplifier AMP has the same voltages +Vin and −Vin across its inputs due to its virtual ground, the voltage $\Delta V_{BE}$ applied to the first resistor $R_1$ can be expressed by Equation 7 below.

$$\Delta V_{BE}=V_{BE2}-V_{BE1}=V_T\cdot\ln n \quad \text{Equation 7}$$

In Equation 7, n denotes the number of bipolar transistors, and VBE1 denotes the base-emitter voltage of n bipolar transistors connected in parallel.

The voltage $\Delta V_{BE}$ applied to the first resistor $R_1$ depends on temperature, with a positive slope of about +0.087 mV/° C., as described above.

Meanwhile, the currents $I_{2a}$ and $I_{2b}$ can be expressed by Equation 8 below on the basis of the first resistor $R_1$ and the third resistor $R_3$.

$$I_{2a} = I_{1a} = \frac{\Delta V_{BE}}{R_1} \qquad \text{Equation 8}$$

$$I_{2b} = \frac{V_{BE2}}{R_3}$$

In Equation 8, since $I_{2a}+I_{2b}=I_2=I_3$, the final reference voltage $V_{ref}$ can be expressed by Equation 9 below.

$$V_{ref} = R_4\left(\frac{V_{BE2}}{R_3} + \frac{\Delta V_{BE}}{R_1}\right) \qquad \text{Equation 9}$$

As can be seen from Equation 9, $V_{BE2}$ decreases in accordance with temperature, and $\Delta V_{BE}$ increases in accordance with temperature. As such, when the value of the fourth resistor R4 is properly adjusted, a final reference voltage $V_{ref}$ that is unaffected by a temperature change can be obtained.

Specifically, the temperature variable that decreases in accordance with temperature generated from the second bipolar transistor Q2 is included in the current $I_{2b}$ flowing to the third resistor $R_3$, and the temperature variable that increases in accordance with temperature generated from the first resistor $R_1$ is included in the current $I_{2a}$. Thus, the current $I_3$ of the final output stage has the following relation: $I_3=I_2=I_{2a}+I_{2b}$. As such, the temperature has the value zero, so that the reference voltage $V_{ref}$ is unaffected by any change in temperature. Here, it is preferable to set the temperature variable to zero by properly adjusting the value of the fourth resistor $R_4$.

Thus, the band-gap reference voltage generator of the present invention is adapted to minimize voltage drop by connecting the second and third resistors $R_2$ and $R_3$ to the first and second bipolar transistors Q1 and Q2 in parallel respectively, and cancel the temperature dependence by adjusting the fourth resistor R4 of the output stage, so that it can provide a stable reference voltage $V_{ref}$ that is unaffected by temperature change, even at a low power supply voltage between 0V and 1V.

2) Elimination of Offset Noise

As described above, a known band-gap reference voltage generator has a problem in that its output voltage varies due to offset noise of the feedback amplifier AMP. In order to minimize this problem, the present invention eliminates the offset noise using chopper stabilization through modulation of input/output voltages. This will be described below in greater detail.

Figure 3:
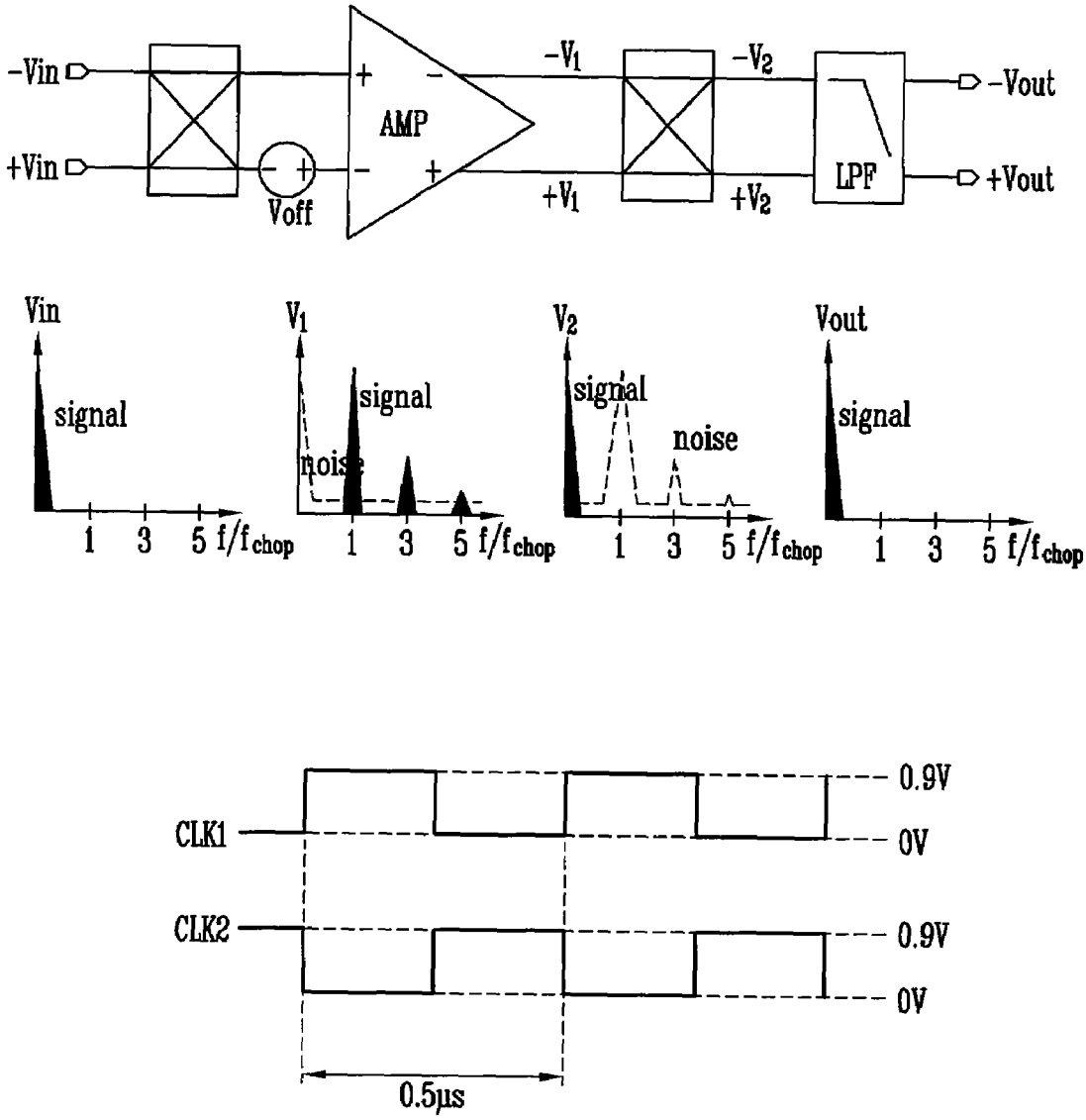
FIG. 3 is a diagram illustrating a method of eliminating offset noise according to the present invention.

FIG. 3 is a diagram illustrating a method of eliminating offset noise according to the present invention.

Referring to FIG. 3, non-inverting input voltage +Vin and inverting input voltage −Vin are crossed with each other at an input stage of the feedback amplifier AMP, and non-inverting output voltage $+V_1$ and inverting output voltage $-V_1$ are crossed with each other at an output stage of the feedback amplifier AMP. Further, non-inverting offset voltage $+V_{off}$ and inverting output voltage $-V_{off}$ are crossed with each other at the output stage of the feedback amplifier AMP. The LPF is connected to the final output stage of the feedback amplifier AMP.

In FIG. 3, the input voltages +Vin and −Vin are switched twice until they are output, and the offset voltages $+V_{off}$ and $-V_{off}$ are switched once until they are output. Here, the switching is conducted by the first and second clocks CLK1 and CLK2.

When the input voltages +Vin and −Vin go through the first switching, frequencies of the input voltages +Vin and −Vin are modulated into odd harmonics of the clock frequencies. The demodulated frequencies of the input voltages are restored to original frequencies of the input voltages while going through the second switching.

However, since the offset voltages $+V_{off}$ and $-V_{off}$ go through only one switching, frequencies of the non-inverting offset voltage $+V_{off}$ and inverting output voltage $-V_{off}$ are modulated into odd harmonics of the clock frequencies at this time. The clock frequencies belong to a higher frequency region than the frequencies of the input voltages +Vin and −Vin and the offset voltages $+V_{off}$ and $-V_{off}$. Thus, when the LPF is connected to the final output stage, the offset voltages, which have been modulated into the odd harmonics of the clock frequencies, fail to pass through the LPF. Thereby, the offset noise is eliminated.

In this manner, the present invention is based on the principle of eliminating the offset noise. The process of eliminating the offset noise from the band-gap reference voltage generator of the present invention will be described below in greater detail.

Referring to FIG. 2, the first voltage modulator MOD1 connected to the input stage of the feedback amplifier AMP crosses the two different input voltages +Vin and −Vin to allow the frequencies of the input voltages +Vin and −Vin to be modulated into the odd harmonics of the clock frequencies. In other words, when the first clock CLK 1 becomes "0", and thus the eighth and tenth PMOS transistors M8 and M10 serving as switches are turned on, the voltage +Vin of the second node is input to the sixth node N6, and the voltage −Vin of the third node is input to the seventh node N7. In contrast, when the second clock CLK 2 becomes "0", and thus the ninth and eleventh PMOS transistors M9 and M11 serving as switches are turned on, the voltage +Vin of the second node is input to the seventh node N7, and the voltage −Vin of the third node is input to the sixth node N6.

Further, the second voltage modulator MOD2 connected to the output stage of the feedback amplifier AMP crosses the two different output voltages $+V_1$ and $-V_1$ to allow the modulated frequencies of the input voltages to be restored to their original frequencies. In other words, when the first clock CLK 1 becomes "0", and thus the twelfth and fourteenth PMOS transistors M12 and M14 are turned on, the voltage $-V_1$ of the node B is input to the first node N1. In contrast, when the second clock CLK 2 becomes "0", and thus the thirteenth and fifteenth PMOS transistors M13 and M15 are turned on, and the voltage $+V_1$ of the node A is input to the first node N1. At this time, the offset voltages $V_{off}$ are modulated into odd harmonics of the clock frequencies. Thus, the modulated frequencies of the offset voltages are filtered by the LPF connected to the final output stage. Thereby, the offset noise is eliminated.

As described above, the band-gap reference voltage generator of the present invention can provide a low reference voltage suitable for a low power design and relatively unaffected by offset noise.

Figure 4:
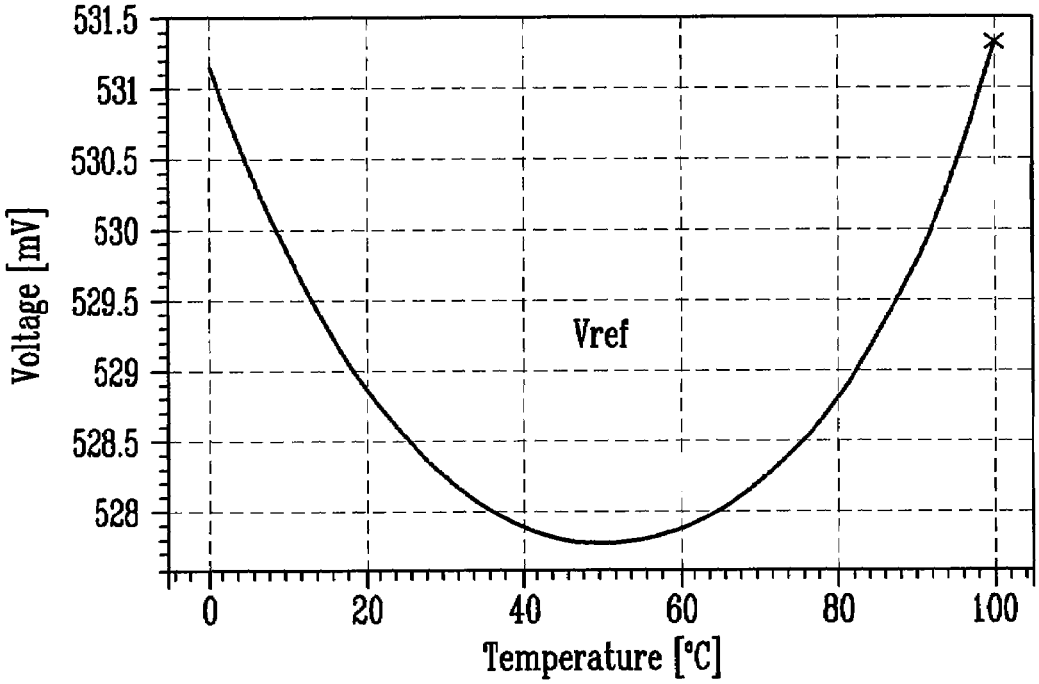
FIG. 4 is a graph of reference voltage versus temperature of the band-gap reference voltage generator of FIG. 2.

FIG. 4 is a graph of reference voltage versus temperature of the band-gap reference voltage generator of FIG. 2. This graph is a result of a computer simulation using transistors having a low threshold voltage in order to minimize voltage drop under a low power supply voltage $V_{DD}$ of 0.9V.

As can be seen from FIG. 4, when the temperature changed from 0° C. to 100° C., variation of the reference voltage $V_{ref}$ output from the band-gap reference voltage generator of the present invention was about 3.5 mV. Thus, it was found that the band-gap reference voltage generator had a temperature compensation characteristic.

Figure 5:
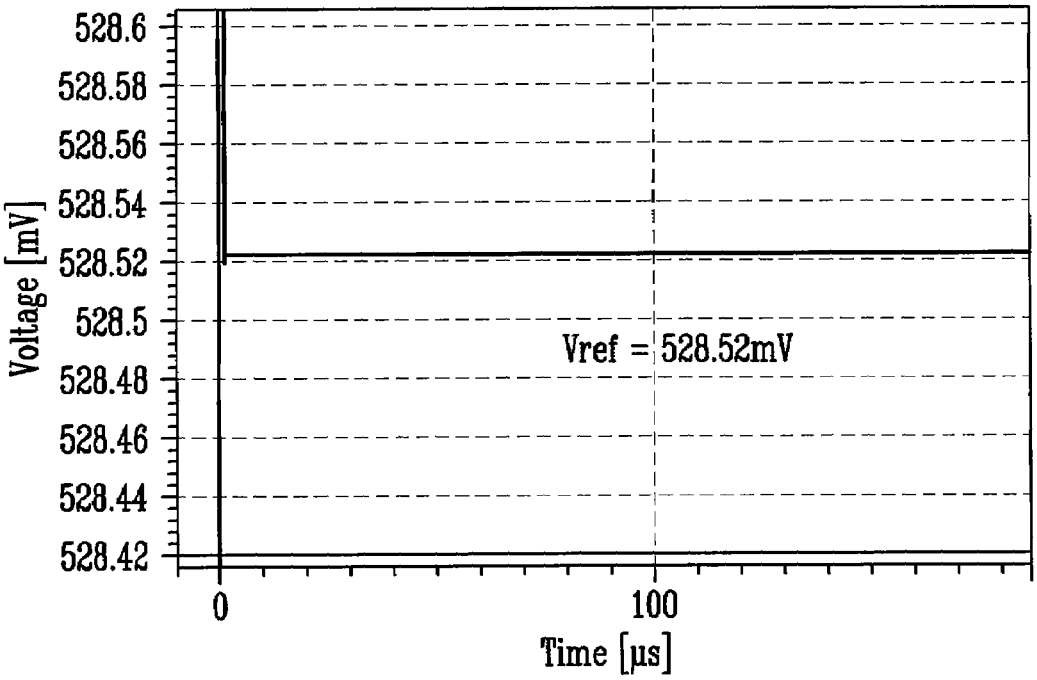
FIGS. 5 and 6 are graphs showing the simulated performance of a feedback amplifier used for a band-gap reference voltage generator when there is an offset of zero and about 2%, respectively.
Figure 6:
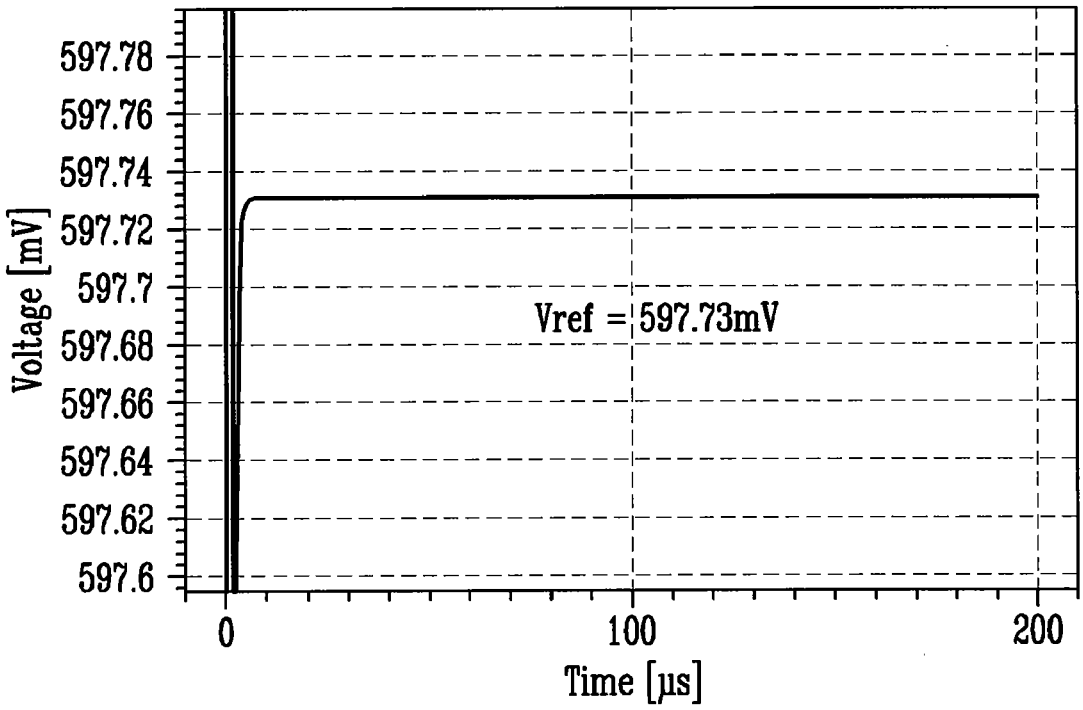
Figure 7:
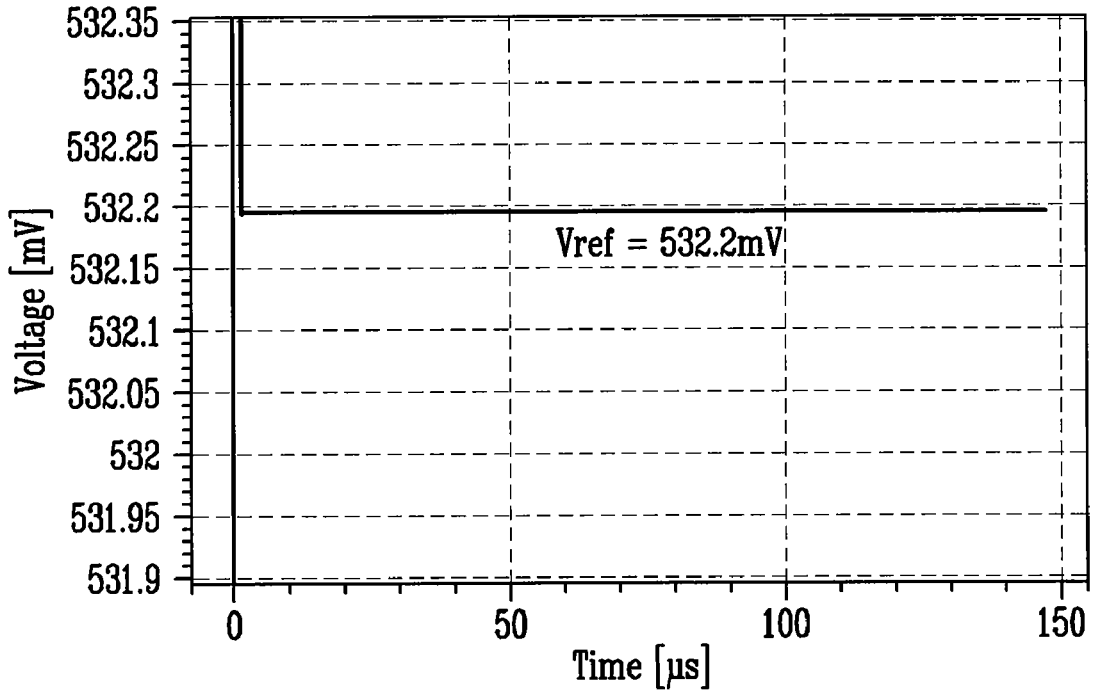
FIG. 7 is a graph showing the simulated performance of a feedback amplifier whose input and output voltages are crossed with each other at input and output stages and whose offset is about 2%.

FIGS. 5 and 6 are graphs showing the simulated performance of a feedback amplifier used for a band-gap reference voltage generator when there is an offset of zero and about 2%, respectively. FIG. 7 is a graph showing the simulated performance of a feedback amplifier whose input and output voltages are crossed with each other at input and output stages and whose offset is about 2%.

Referring to FIGS. 5 and 6, when the feedback amplifier had zero offset, the reference voltage $V_{ref}$ had a value of 528.52 mV (25° C.). When the feedback amplifier had an offset of about 2%, the reference voltage $V_{ref}$ had a value of 597.73 mV (25° C.). In other words, in the case where the feedback amplifier had an offset of about 2%, it was found that the reference voltage $V_{ref}$ was 69.21 mV (25° C.) higher than when the feedback amplifier had no offset.

On the contrary, referring to FIG. 7, when the input voltages and the output voltages of the feedback amplifier having an offset of about 2% were crossed with each other, the reference voltage $V_{ref}$ was about 532.2 mV (25° C.). Thus, it was verified that the reference voltage $V_{ref}$ was only 3.68 mV (25° C.) higher than when the feedback amplifier had no offset.

Thus, it was found from this simulation that the band-gap reference voltage generator of the present invention can reduce variation of the reference voltage depending on the offset of the feedback amplifier up to about 95% through chopper stabilization based on modulation of the input/output voltages.

According to the present invention, the band-gap reference voltage generator for low-voltage operation and high precision can reduce the reference voltage to 1V or less, so that it can provide a stable reference voltage that is unaffected by a change in temperature, even at a low power supply voltage.

Further, the band-gap reference voltage generator can minimize reference voltage variation caused by offset noise generated from the feedback amplifier, so that it can provide a precise reference voltage.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A band-gap reference voltage generator for low-voltage operation and high precision, comprising:

first through third p-channel metal oxide semiconductor (PMOS) transistors, gates and sources of which are connected to a first node and a power supply terminal respectively, drains of which are connected to second, third and fourth nodes respectively, and which are configured as current mirrors;

a feedback amplifier, which includes fourth and fifth PMOS transistors configured as current mirrors and first and second n-channel metal oxide semiconductor (NMOS) transistors, wherein non-inverting and inverting input voltages are input to gates of the first and second NMOS transistors respectively, and non-inverting and inverting output voltages are output from drains of the fourth and fifth PMOS transistors respectively;

a first resistor connected to the second node and a fifth node;

second, third and fourth resistors, which are connected between the second, third and fourth nodes and ground, respectively, the fourth node being a common node shared by a drain of the third PMOS transistor and one end of the fourth resistor;

an output node configured to output a reference voltage, the output node being connected to the fourth node;

a first bipolar transistor, which is connected with the second resistor in parallel, an emitter of which is connected to the fifth node, and a collector and a base of which are grounded;

a second bipolar transistor, which is connected with the third resistor in parallel, an emitter of which is connected to the third node, and a collector and a base of which are grounded a first voltage modulator, which is connected to the gates of the first and second NMOS transistors, and crosses and modulates the non-inverting and inverting input voltages;

a second voltage modulator, which is connected to the drains of the fourth and fifth PMOS transistors, and crosses and modulates the non-inverting and inverting output voltages; and a low-pass filter, which is connected between the fourth node and the ground, and passes low-frequency signals of voltage of the fourth node, wherein the first voltage modulator crosses the non-inverting and inverting input voltages to cause frequencies of the non-inverting and inverting input voltages to be modulated into odd harmonics of frequencies of the first and second clocks, and wherein the second voltage modulator crosses the non-inverting and inverting output voltages to cause frequencies of the non-inverting and inverting output voltages to be restored to the frequencies of the non-inverting and inverting input voltages.

2. The band-gap reference voltage generator according to claim 1, wherein the reference voltage has a value of no more than 1V, wherein a drain of the fourth PMOS transistor and a drain of the first NMOS transistor share a common node, and a drain of the fifth PMOS transistor and a drain of the second NMOS transistor share a common node.

3. The band-gap reference voltage generator according to claim 1, wherein the fourth resistor is adjusted for resistance such that the reference voltage is unaffected by a change in temperature, wherein the second node is a node commonly shared by a drain of the first PMOS transistor and one end of the first resistor.

4. The band-gap reference voltage generator according to claim 1, wherein the fourth and fifth PMOS transistors have sources connected to the power supply terminal in common, gates connected to each other, and drains connected to drains of the first and second NMOS transistors respectively, and wherein the second node is a node commonly shared by a drain of the first PMOS transistor and one end of the first resistor.

5. The band-gap reference voltage generator according to claim 1, wherein the first voltage modulator comprises:

eighth and ninth PMOS transistors having gates to which first and second clocks are applied, and which are configured as switches; and tenth and eleventh PMOS transistors having gates to which the first and second clocks are applied, and which are configured as switches; and sources of the eighth and ninth PMOS transistors and drains of the tenth and eleventh PMOS transistors are connected to the gates of the first and second NMOS transistors in common.

6. The band-gap reference voltage generator according to claim 1, wherein the second voltage modulator comprises:

twelfth and thirteenth PMOS transistors having gates to which first and second clocks are applied, and which are configured as switches; and fourteenth and fifteenth PMOS transistors having gates to which the first and second clocks are applied, and which are configured as switches; and drains of the twelfth and thirteenth PMOS transistors and sources of the fourteenth and fifteenth PMOS transistors are connected to the drains of the fourth and fifth PMOS transistors in common.

7. The band-gap reference voltage generator according to claim 1, wherein the second voltage modulator crosses the non-inverting and inverting offset voltages of the feedback amplifier to cause the frequencies of the non-inverting and inverting offset voltages to be modulated into the odd harmonics of the first and second clock frequencies.

8. The band-gap reference voltage generator according to claim 7, wherein the non-inverting and inverting offset voltages, which are modulated into the odd harmonics of the first and second clock frequencies, are filtered by the low-pass filter.

9. The band-gap reference voltage generator according to claim 1, wherein the low-pass filter is adapted so that a capacitor is connected to the fourth resistor in parallel.

10. The band-gap reference voltage generator according to claim 1, further comprising a sixteenth NMOS transistor, to a gate of which bias voltage is applied, wherein the sixteenth NMOS transistor has a drain connected to sources of the first and second NMOS transistors, and a source connected to the ground.

* * * * *